US005801732A

United States Patent [19]

Pengelly

[11] Patent Number: 5,801,732

[45] Date of Patent: Sep. 1, 1998

[54] PIEZO IMPULSE INK JET PULSE DELAY TO REDUCE MECHANICAL AND FLUIDIC CROSS-TALK

[75] Inventor: Dennis H. Pengelly, Southbury, Conn.

[73] Assignee: Dataproducts Corporation, Simi Valley, Calif.

[21] Appl. No.: 556,768

[22] Filed: Nov. 2, 1995

Related U.S. Application Data

[63] Continuation-in-part of Ser. No. 530,946, Sep. 20, 1995, which is a continuation-in-part of Ser. No. 310,967, Sep. 23, 1994.

[51] Int. Cl.[6] ..... B41J 2/045; B41J 29/38

[52] U.S. Cl. ..... 347/70; 347/10

[58] Field of Search ..... 347/70, 71, 12, 347/40, 41, 16, 9, 10

[56] References Cited

U.S. PATENT DOCUMENTS

| | | | |
|---|---|---|---|
| 4,032,929 | 6/1977 | Fischbeck et al. . | |
| 4,194,210 | 3/1980 | Krause | 346/75 |
| 4,300,144 | 11/1981 | Isayama et al. | 347/12 |
| 4,357,614 | 11/1982 | Tamai | 346/75 |
| 4,379,304 | 4/1983 | Heinzl et al. | 346/140 |
| 4,396,924 | 8/1983 | Rosenstock | 346/140 |
| 4,459,601 | 7/1984 | Howkins | 346/140 |
| 4,646,106 | 2/1987 | Howkins | 346/1.1 |
| 4,680,595 | 7/1987 | Cruz-Uribe et al. . | |
| 4,714,934 | 12/1987 | Rogers | 346/140 |
| 4,901,093 | 2/1990 | Ruggiero et al. . | |
| 4,965,539 | 10/1990 | Hickman | 347/16 |
| 5,142,296 | 8/1992 | Lopez et al. | 346/1.1 |
| 5,280,310 | 1/1994 | Otsuka et al. | 347/12 |
| 5,422,666 | 6/1995 | Koyama et al. | 347/41 |
| 5,450,111 | 9/1995 | Mutoh | 347/78 |

FOREIGN PATENT DOCUMENTS

| | | |
|---|---|---|
| 56-93567 | 7/1981 | Japan . |
| 56-135078 | 10/1981 | Japan . |
| 57-188372 | 11/1982 | Japan . |
| 60-92865 | 5/1985 | Japan . |

*Primary Examiner*—Benjamin R. Fuller
*Assistant Examiner*—Thinh Nguyen
*Attorney, Agent, or Firm*—Woodcock Washburn Kurtz Mackiewicz & Norris LLP

[57] ABSTRACT

An ink jet apparatus comprising an array of impulse ink jets is disclosed. Each of the ink jets includes a chamber having an orifice and a transducer coupled to the chamber, a signal generator applying firing signals to each transducer of each of the ink jets to eject droplets of ink on demand, and a controller for controlling the phase of the firing signals to prevent the simultaneous application of the firing signals to adjacent ink jets in the array. The orifices are linearly aligned and adjacent ink jets produce ink drops offset by less than the diameter of the drops. The natural ringing of the piezo crystals of the ink jet transducers has been found to occur at a frequency of about 46 kHz (period=22 μs), and so a delay of about 25 ms, one-half the ringing period, is used to minimize cross-talk among neighboring channels.

13 Claims, 8 Drawing Sheets

PIEZO IMPULSE INK JET PULSE DELAY TO REDUCE MECHANICAL AND FLUIDIC CROSS-TALK

CROSS-REFERENCES TO RELATED APPLICATIONS

This is a continuation-in-part of U.S. patent application Ser. No. 08/530,946 (attorney docket no. TRID-0068), filed Sept. 20, 1995, which is a continuation-in-part of U.S. patent application Ser. No. 08/310,967 (attorney docket no. TRID-0057), filed Sept. 23, 1994.

BACKGROUND OF THE INVENTION

The present invention relates to impulse or drop-on demand ink jet printers employing an array of ink jets which are capable of printing a substantial field of droplets on demand. U.S. Pat. No. 4,714,934 discloses an ink jet apparatus of the type shown in FIGS. 1 through 3. The apparatus includes a print head 10 having a reservoir 12 and an imaging head 14. The print head 10 is juxtaposed to a target 16 which is advanced by means of a transport system, including rollers 18 and 20, in an incremental fashion. Print head 10 includes an orifice plate 22, including orifices 24. In FIG. 1, the orifices are shown further apart from each other than they are in practice for purposes of illustration.

The orifices 24 actually comprise a plurality of sets of orifices, which are more fully described with reference to FIGS. 2 and 3. The sets of orifices 24 are vertically displaced as a result of the inclination of the print head 10 with respect to the scanning direction depicted by arrow 26. The orifices 24 are arranged in groups of three (3) and inclined on the orifice plate 22 so as to be substantially vertical when the print head 10 is inclined with respect to the scanning direction 26 as shown in FIG. 1. The hash marks 28 show this angle of inclination. The angle of the orifices 24 in each group with respect to the vertical is chosen such that when the orifice plate 22 is inclined as shown in FIG. 1, sets of orifices 24 will be vertically aligned. As scanning in the direction depicted by the arrow 26 proceeds, there is no overlap of any droplets projected from the orifices so as to permit the apparatus as shown in FIGS. 1 through 3 to create a vertical bar when the droplets are ejected sequentially in the proper timed relationship. Of course, the droplets can also produce an alphanumeric character by ejecting appropriate droplets on demand.

By changing the angle of inclination of the hash marks 28, it is possible to change the angle of inclination of the print head 14. However, if the angle of inclination is increased beyond a certain limit, it becomes impossible to print a continuous bar since the orifices cannot be spaced sufficiently close together to provide full coverage of the field. In addition, the chambers associated with those orifices become starved for ink when operated at a sufficiently high frequency. Moreover, it has not been possible to increase the number of chambers since cross-talk and limited space do not allow transducers to be coupled to the chambers.

Mechanical and fluidic cross-talk causes a reduction in the jet velocity in piezo impulse technology when adjacent jets are fired. For example, when printing a large black area (i.e., many or all channels are fired), the inner or center channels produce ink drops with reduced velocity. This effect (sometimes called the "graying out" effect) is additive and increases as the channels density increases. One way to minimize cross-talk involves the use of ink jet chambers, orifices and chamber shapes constructed and arranged as disclosed below and in the above-cited U.S. Pat. Application Ser. No. 08/530,946 (attorney docket no. TRID-0068). Another approach to increasing the channel velocity is to increase the overall firing voltage, but this results in increased radio frequency interference and does not satisfactorily reduce the graying out effect.

U.S. Pat. No. 5,142,296, Aug. 25, 1992, titled "Ink Jet Nozzle Crosstalk Suppression," discloses an ink jet printer having ink jet channels that are individually controlled to produce ink dots on a printing medium. Cross-talk is reduced by activating each odd numbered channel in alternation with each even numbered channel while offsetting the orifices of one group of channels from the other to compensate for the time difference between activations. In addition, the voltage supplied to excite the channel transducers is varied as a function of the number of channels simultaneously excited to maintain a fixed excitation voltage across each transducer.

One shortcoming of the prior art is that, with the orifices offset, complex and costly electronic delay mechanisms are required.

SUMMARY OF THE INVENTION

Accordingly, an object of the present invention is to provide a mechanism for reducing cross-talk (e.g., mechanical and fluidic cross-talk) in an ink jet apparatus having linearly aligned (i.e., not offset) arrays of orifices. In achieving this object, the present invention provides a pulse delay method whereby one bank of channels is fired first and then another bank of channels is fired after a predetermined delay (e.g., approximately 20 microseconds plus or minus 5 μs). Although this method produces a very slight print delay in the second channel, which is usually not noticeable, the benefits of the cross-talk reduction outweigh the disadvantages of the print offset. (Note that the offset is given by: paper speed (in./sec.) times delay (sec.)=offset distance (in.). For example, with a paper speed of 120 in./sec. and a delay of 0.000014 sec., the offset distance is 0.00168 in., which is 14% of a typical ink dot having a diameter of 0.012 in.) With this invention, the distance between the firing jets is at least doubled since the odd and even jets are not fired at the same time. Thus, the present invention provides an improved printed image because it will be darker and not exhibit the graying out effect discussed above.

Another advantageous feature of the present invention is that less power is required to fire the jets since at most only half the jets are fired at one time. In addition, radio frequency interference is reduced by the present invention.

An ink jet apparatus in accordance with the present invention comprises an array of impulse ink jets. Each of the jets includes a chamber having an orifice and a transducer coupled to the chamber. The ink jet apparatus also includes signal generating means for applying firing signals to each transducer of each of the ink jets for ejecting droplets of ink on demand, and means for controlling the firing signals to prevent the simultaneous application of the firing signals to adjacent ink jets in the array. Preferably, the adjacent ink jets produce ink drops offset by less than the diameter of the drops.

In a presently preferred embodiment of the invention, the firing signals applied to the adjacent jets are offset in time by a portion of the cycle of the natural ringing of each of the transducers. Furthermore, in this embodiment the portion of the cycle is equal to substantially half the cycle.

The means for generating firing signals preferably includes means for generating a plurality of firing signals of substantially the same phase, and the means for controlling the firing signals preferably comprises means for delaying the phase of a first set of firing signals relative to a second set of firing signals.

The array of ink jets preferably includes a first set of ink jets coupled to the first set of firing signals and a second set of ink jets coupled to the second set of firing signals, the first set of ink jets being interposed between the second set of ink jets.

According to another aspect of the invention, the ink jet apparatus includes an array of impulse ink jets including a first bank of ink jets and a second bank of ink jets. The first bank of ink jets is interposed and located between the second bank of ink jets respectively. The apparatus also includes means for controlling the phase of the firing signals to prevent the simultaneous application of firing signals to an ink jet in the first bank and an ink jet in the second bank. Again, the adjacent ink jets produce ink drops offset by less than the diameter of the drops. Typically, and preferably, the offset is less than 15% of the ink drop diameter.

In presently preferred embodiments of the invention, the array is substantially linear, and the space between adjacent ink jets in the first bank and the second bank is sufficiently close to result in cross-talk if the ink jets are fired substantially simultaneously. The spacing between an ink jet in the first bank and an ink jet in the second bank is preferably less than 0.250 inches.

A method of operating an ink jet apparatus in accordance with the present invention comprises generating a plurality of firing signals, changing the phase of the firing signals, and applying the firing signals to the ink jets in the array such that the firing signals of adjacent ink jets in the array are displaced in phase.

Other features and advantages of the invention are disclosed below.

DETAILED DESCRIPTION OF PREFERRED EMBODIMENTS

Figure 1:
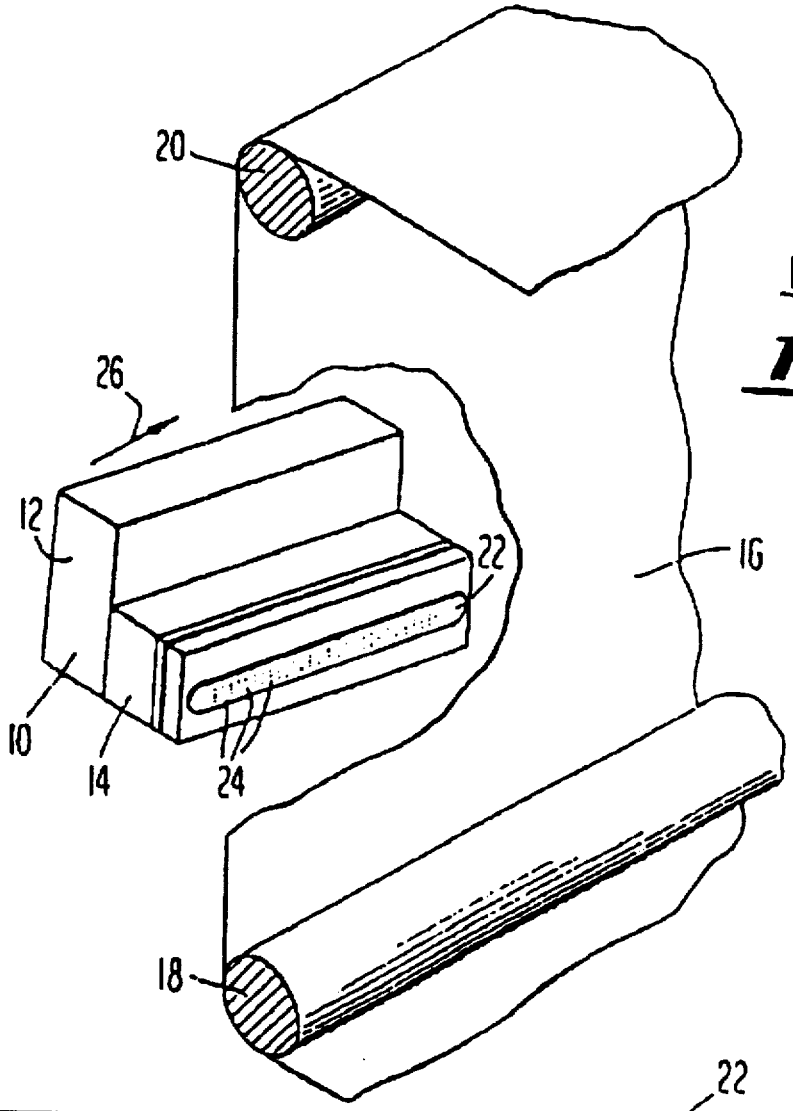
PRIOR ART Fig. 1
FIG. 1 is a perspective view of the prior art ink jet printing apparatus previously discussed.
Figure 2:
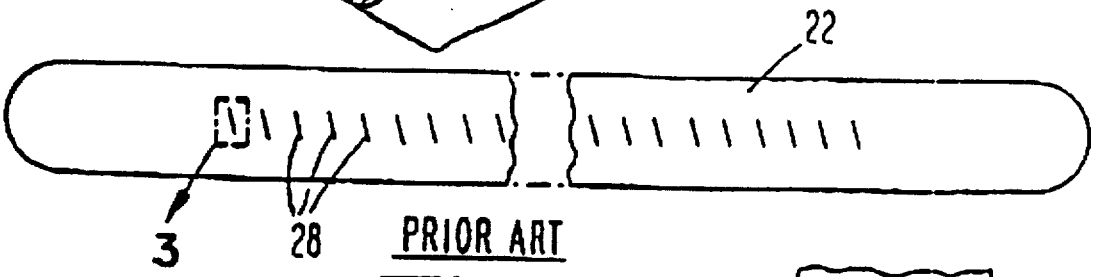
PRIOR ART Fig. 2
FIG. 2 is a plan view of an orifice plate of the prior art apparatus shown in FIG. 1.
Figure 3:
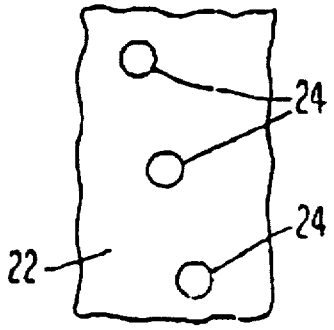
PRIOR ART Fig. 3
FIG. 3 is a fragmentary view of the fragment 3 of the prior art apparatus shown in FIG. 2.
Figure 4:
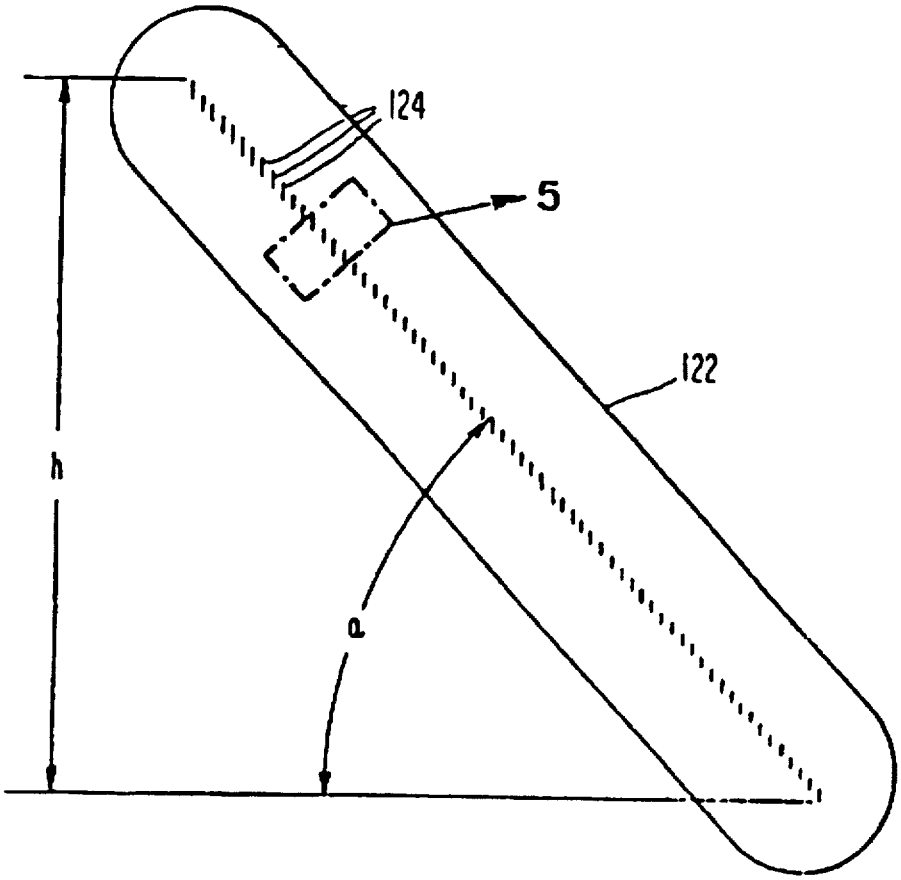
FIG. 4 is a plan view of an orifice plate of a presently preferred embodiment of an ink jet apparatus in accordance with the present invention.
Figure 5:
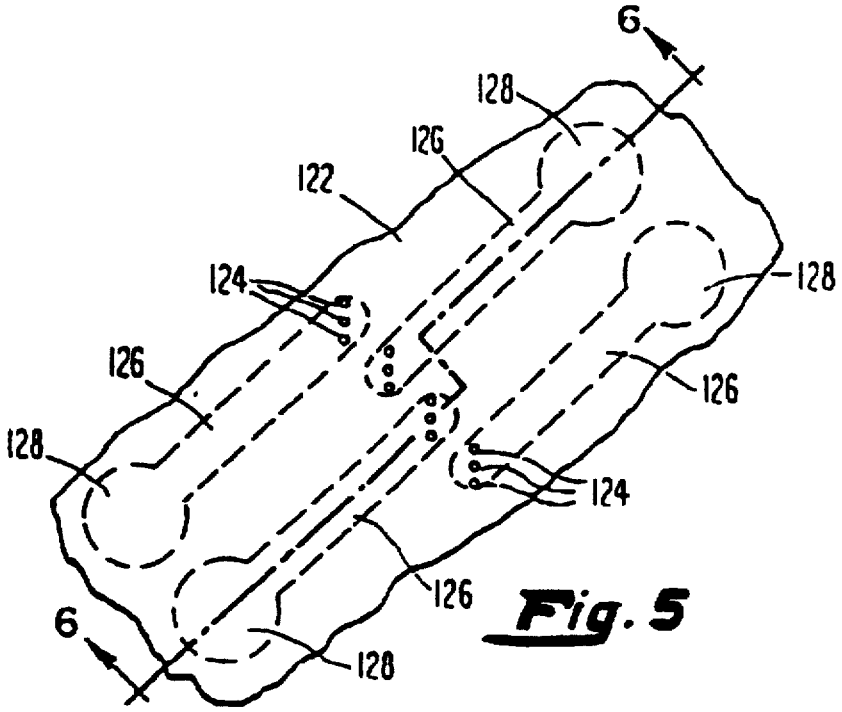
FIG. 5 is an enlarged view of the fragment 5 shown in FIG. 4.

Referring to FIGS. 4 and 5, one presently preferred embodiment of the invention comprises an orifice plate 122 having groups of three orifices 124 forming a linear array. In all, a total of 64 groups of orifices 124 are shown. Each linear array of orifices 124 is inclined such that the orifices 124 are vertically disposed with respect to the scanning direction when incorporated in a print head similar to that shown in FIG. 1. The angle of inclination of the orifice plate and thus the linear array of orifices 124 is 47.105 degrees so as to provide an overall field height h of 1.36 inches. As should be appreciated, the spacing between the groups of orifices 124 is necessarily small.

As shown in FIG. 5, the orifices 124 terminate ink jet chambers 126 in drop-on-demand or impulse devices. Because the chambers 126 are closely spaced, it is not possible to confine the chambers to the area between adjacent groups of orifices 124. Rather, it is necessary to laterally extend the chambers 126 in opposite directions so as to provide actuation locations 128 that are laterally displaced from the linear arrays. The actuation locations 128 of adjacent chambers 126 are mutually laterally displaced. By virtue of this lateral displacement, there may be sufficient room for elongated transducers 130, shown in FIG. 6, to eject droplets of ink on demand from the orifices 124 without cross-talk between chambers.

Figure 6:
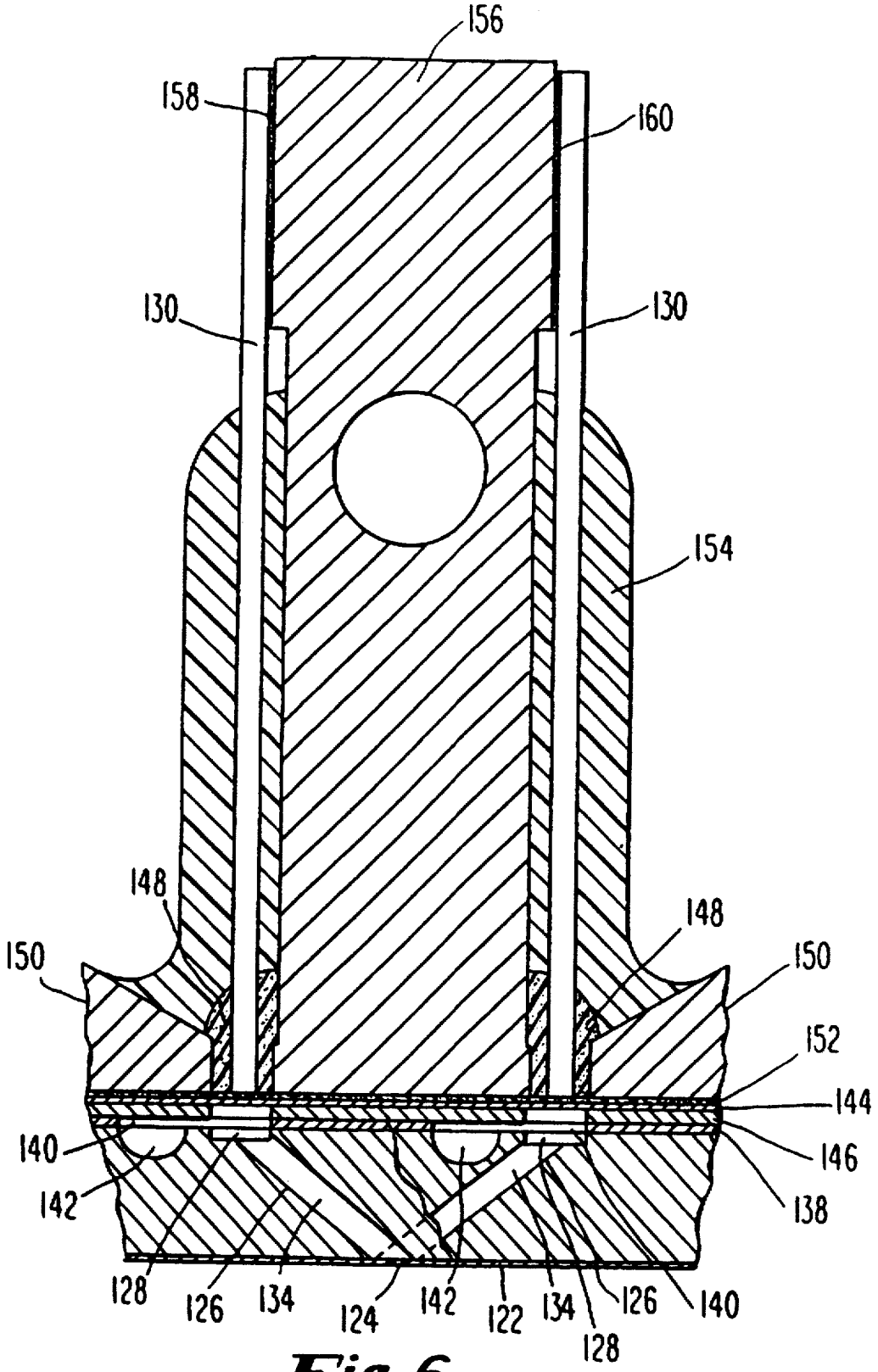
FIG. 6 is a sectional view of the ink jet apparatus of FIG. 4 taken along line 6—6 of FIG. 5.
Figure 7A:
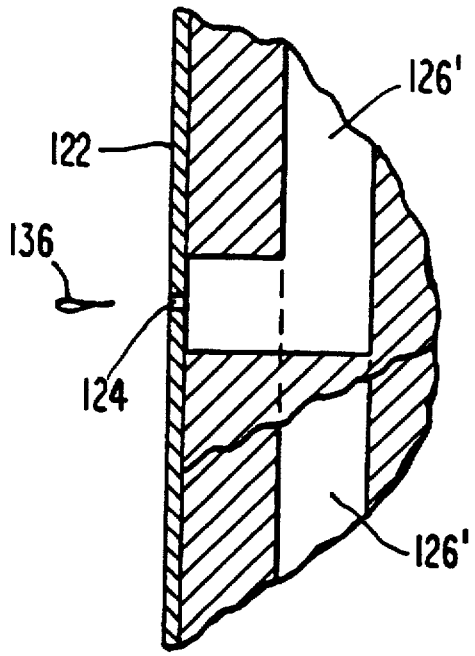
FIG. 7A is a view similar to FIG. 7 but of the embodiment depicted in FIG. 6A.
Figure 6A:
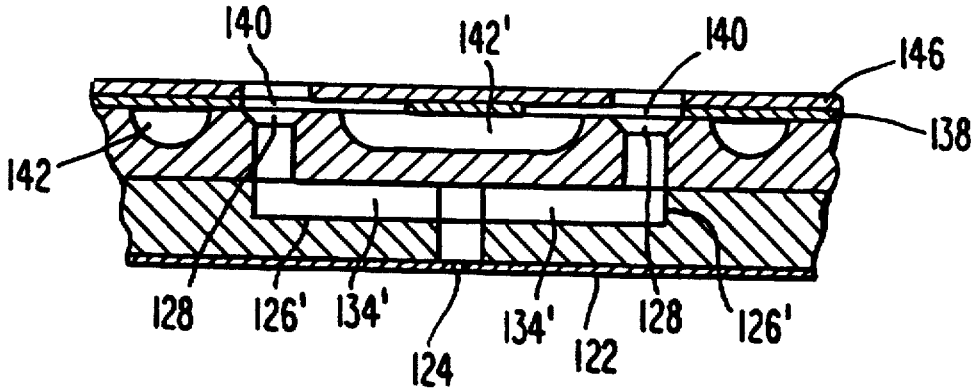
FIG. 6A is a partial view similar to FIG. 6 but depicting an embodiment in which elongated portions of chambers 126 are implemented with right angles.
Figure 7:
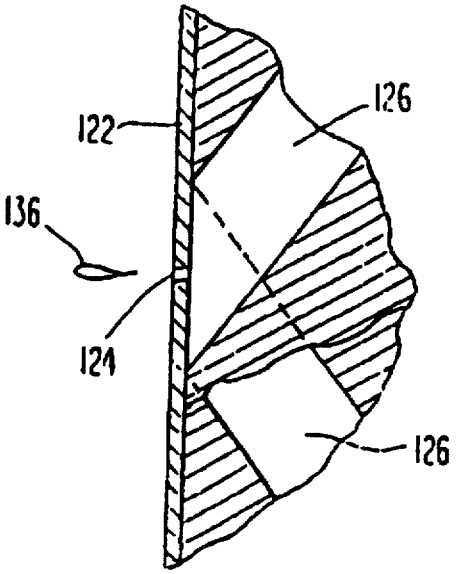
FIG. 7 is an enlarged fragmentary view of a fragment of FIG. 6.

As shown in FIGS. 6, 6A, 7 and 7A, the chambers 126 or 126' may include either elongated sections 134, which are disposed at an acute angle with respect to the axis of ejection of droplets from orifices 124 as well as the axis of elongation of the transducers 130, or elongated sections 134', which contain 900 bends as shown. The inclined or elbowed, elongated portions 134 or 134' of the chambers 126 or 126' create a fanning-in effect to permit alignment of the groups of orifices 124 in a linear array while providing separation of the elongated transducers 130. Note that only a single orifice is shown in FIGS. 7 and 7A since the sections represented by FIGS. 6, 6A, 7 and 7A is through a single orifice. However, there are preferably up to three orifices associated with each of the chambers 126 or 126' shown in FIGS. 6, 6A, 7 and 7A. It is possible to achieve greater chamber density by employing this fanning-in effect. For example, it is possible to achieve a chamber-to-chamber spacing of less than 0.0500 inches, preferably less than 0.0400 inches, and optimally less than 0.0300 inches without cross-talk. The fan-in effect also allows chamber-to-chamber gap spacing of less than ten times the diameter or cross-sectional dimension of the chamber and preferably less than seven times this diameter.

As also shown in FIGS. 6 and 6A, the ink jet apparatus includes a restrictor plate 138 having openings 140 which connect the actuation locations 128 with manifolds 142. The manifolds 142 service an aligned row of actuation locations 128 with ink while another manifold 142 services another aligned row of actuation locations 128 with ink. Additional manifolds 142 external to the elbowed elongated portions 134' of the chambers in FIG. 6A create additional fluidic compliance and permit secondary servicing of center manifold 142' and downstream activation locations 128.

The ink ejected from orifices 124 is separated from the transducer and its mounting materials by a relatively inert diaphragm 144 (see FIG. 6), which preferably is made of stainless steel. Diaphragm 144 moves with the transducers 130 to eliminate ink compatibility problems. To assure that deflection of the diaphragm 144 by the transducers 130 does not affect the size of the restrictor opening 140, a spacer plate 146 is inserted between the diaphragm 144 and the restrictor plate 138. The diaphragm 144 (FIG. 6) is secured to the transducers 130 by an elastomeric adhesive (e.g., silicone) which extends upwardly into openings 148 in a body 150 and forms a layer 152 along the top of the diaphragm 144. As a consequence, retraction of the transducer 130 pulls the diaphragm 144 upwardly at the actuation locations 128 to permit additional ink from the manifolds 142 to enter the chambers 126. When the transducers 130 are deenergized (i.e., electrically grounded), the diaphragm 144 will return to the quiescent, planar condition and droplets of ink 136 will be ejected from the orifices 124, as shown in FIGS. 7 and 7A. In addition to the silicone adhesive, the transducer is secured to the body 150 and a central mounting 156 by an LRTV silicone 154. A conductive epoxy 158 (e.g., a silver epoxy) joins the transducers 130 to the mounting 156 at the extremity remote from the diaphragm 144.

Figure 9:
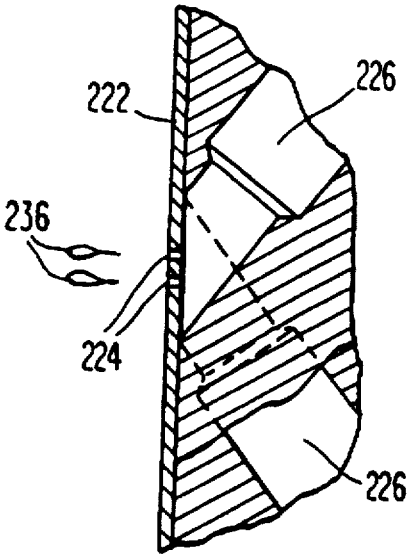
FIG. 9 is a fragmentary sectional view of the apparatus of FIG. 8 taken along line 9—9.
Figure 8:
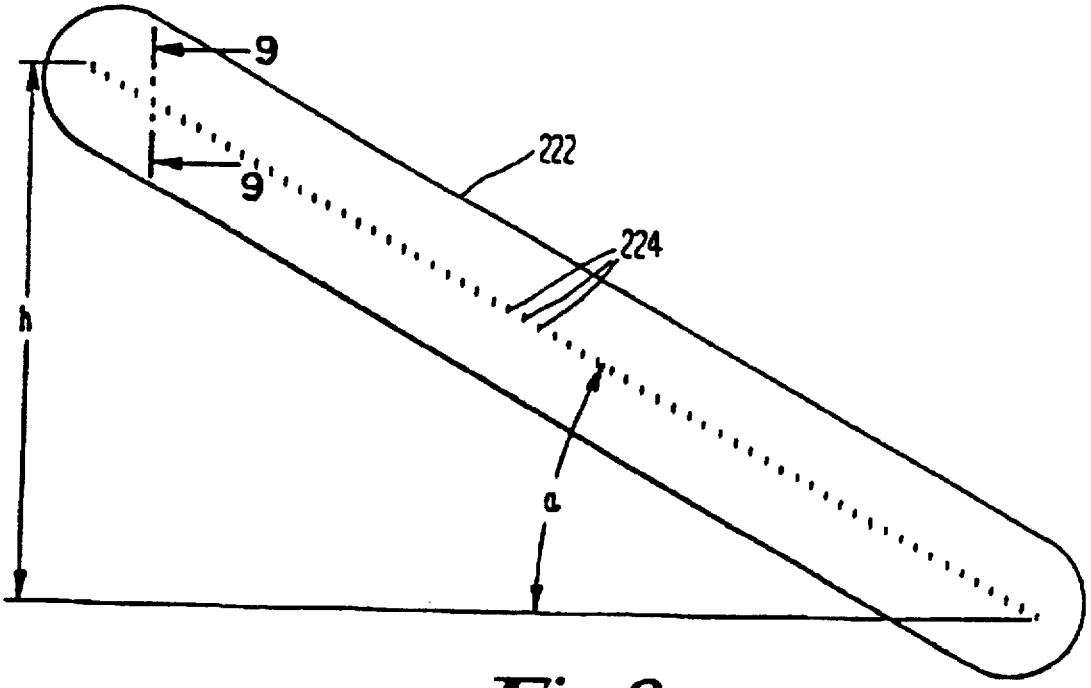
FIG. 8 is a plan view of another embodiment of an orifice plate.

Referring now to FIGS. 8 and 9, the angle of inclination $\alpha$ of an orifice plate 222 may be reduced to 29.236 degrees to provide an overall field height of 0.92 inches. The orifices 224 in this embodiment are arranged in groups of two. Thus, the density of chambers from end to end of the orifice plate, 64 chambers in all, remains the same although the number of orifices is reduced since there are only two orifices 224 per chamber. As in the case of the embodiment of FIGS. 4, 5, 6 and 7, the elongated portions of the chambers 226 are inclined to provide lateral displacement of the actuation locations of the chambers, which are not shown in FIGS. 8 and 9. However, the chambers look substantially as shown in FIGS. 6 and 7 such that the elongated portions of chambers 226 are inclined with respect to the axis of ejection for the droplets 236 as well as the axis of elongation of the elongated transducers.

Figure 11A:
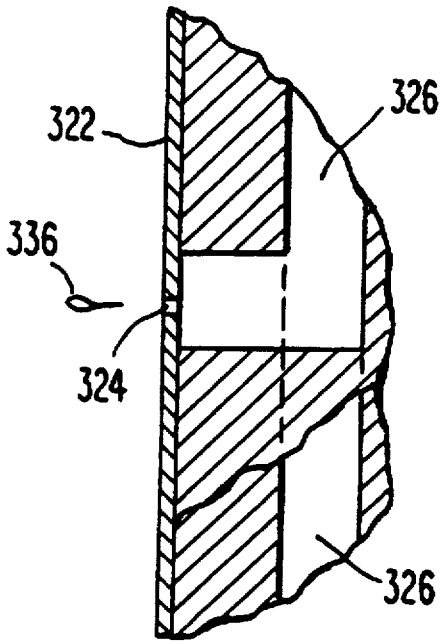
FIG. 11A is a view similar to FIG. 11 but of yet another embodiment similar to that of FIGS. 6A and 7A.
Figure 11:
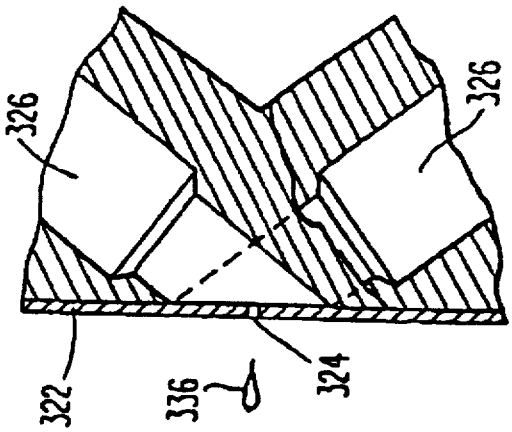
FIG. 11 is an enlarged fragmentary sectional view of the apparatus of FIG. 10 taken along the line 11—11.
Figure 10:
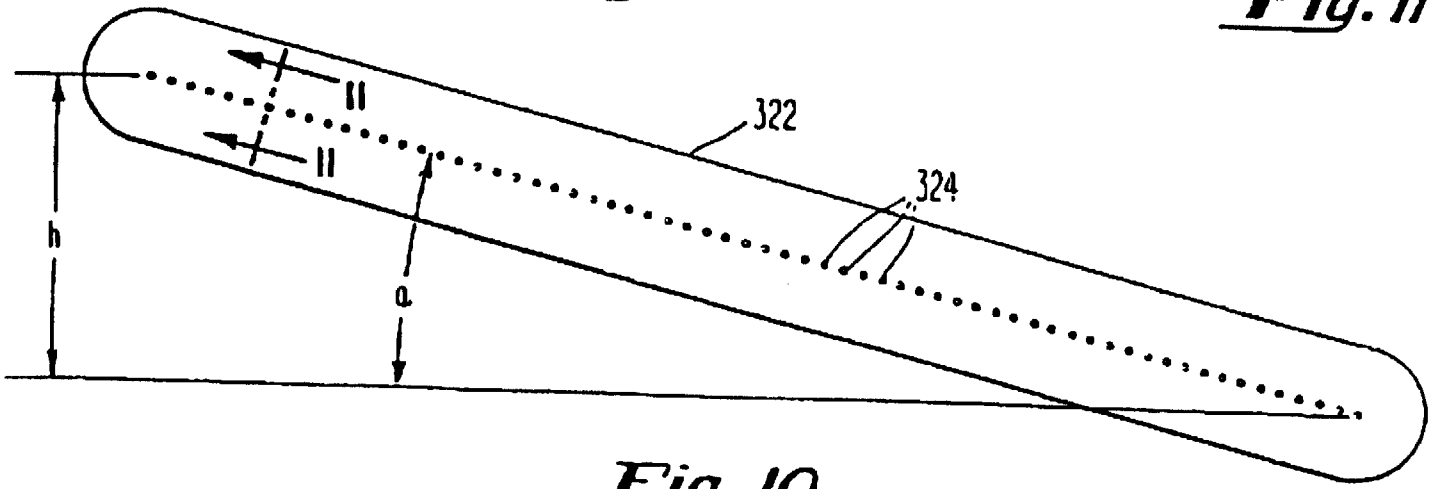
FIG. 10 is a plan view of yet another embodiment of an orifice plate.

Referring now to FIGS. 10, 11 and 11A, an orifice plate 322 is shown having a total of 64 channels terminating in orifices 324. The orifices and channels or chambers are arrayed in linear fashion at an angle $\alpha$ of 14.135 degrees with respect to the scanning axis to provide an overall field dimension h equal to 0.46 inches. As shown in FIG. 11, the chambers 326 are inclined with respect to the axis of ejection of droplets 336. As shown in FIG. 6, the elongated transducers are also inclined with respect to the chambers 326. It will therefore be appreciated that, with reference to FIGS. 10 and 11, there are a total of 64 channels shown with 64 orifices, i.e., one orifice per chamber. This also applies to embodiments of FIGS. 6A and 11A in that there are a total of 64 channels shown with 64 orifices, i.e., one orifice per chamber.

Figure 12:
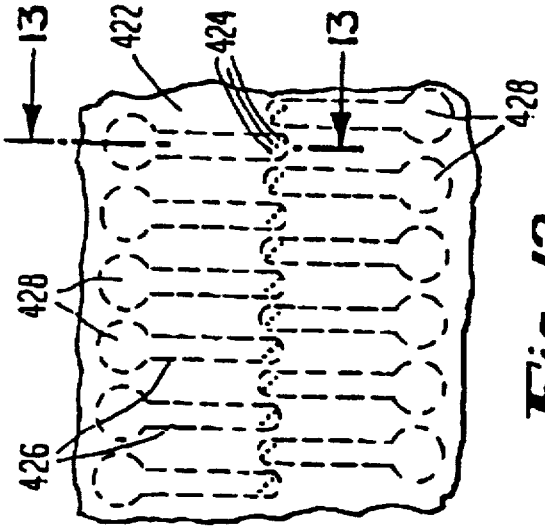
FIG. 12 is a plan view of another embodiment of an orifice plate.
Figure 13:
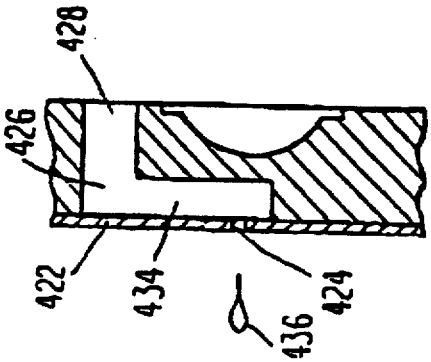
FIG. 13 is a sectional view of the apparatus of FIG. 12 taken along the line 13—13.

FIG. 12 depicts an orifice plate 422 having groups of orifices 424, i.e., 3 orifices per channel or group. The chambers 426 extend laterally outwardly from the linear array of orifices 424 such that actuation locations 428 are laterally displaced from the linear array. As shown in FIG. 13, the chambers 428 are not inclined with respect to the axis of ejection of droplets 436 but are formed with a right angle configuration. A first portion 434 extends laterally outwardly from the orifice to the actuation location 428. A single manifold, through the use of a restrictor plate (not shown), serves all chambers extending laterally outwardly from the linear array.

With the various embodiments described, it will be appreciated that the center-to-center spacing between the chambers may be substantially reduced, thereby providing increased resolution. It will be appreciated that various configurations of chambers, orifices and chamber shapes may be utilized. For example, an array of 128 or 256 chambers or more may be employed. It is also possible to terminate chambers in more than three orifices. For example, chambers terminating in four, five or six orifices or more are possible. Finally, it is possible to use various chamber shapes in addition to the inclined, elbowed or L-shaped chambers disclosed herein. It will further be appreciated that alignment of the array of orifices in linear fashion allows the use of various angles of inclination of the head thereby permitting a wide variety of applications of the ink jet apparatus.

Figure 14:
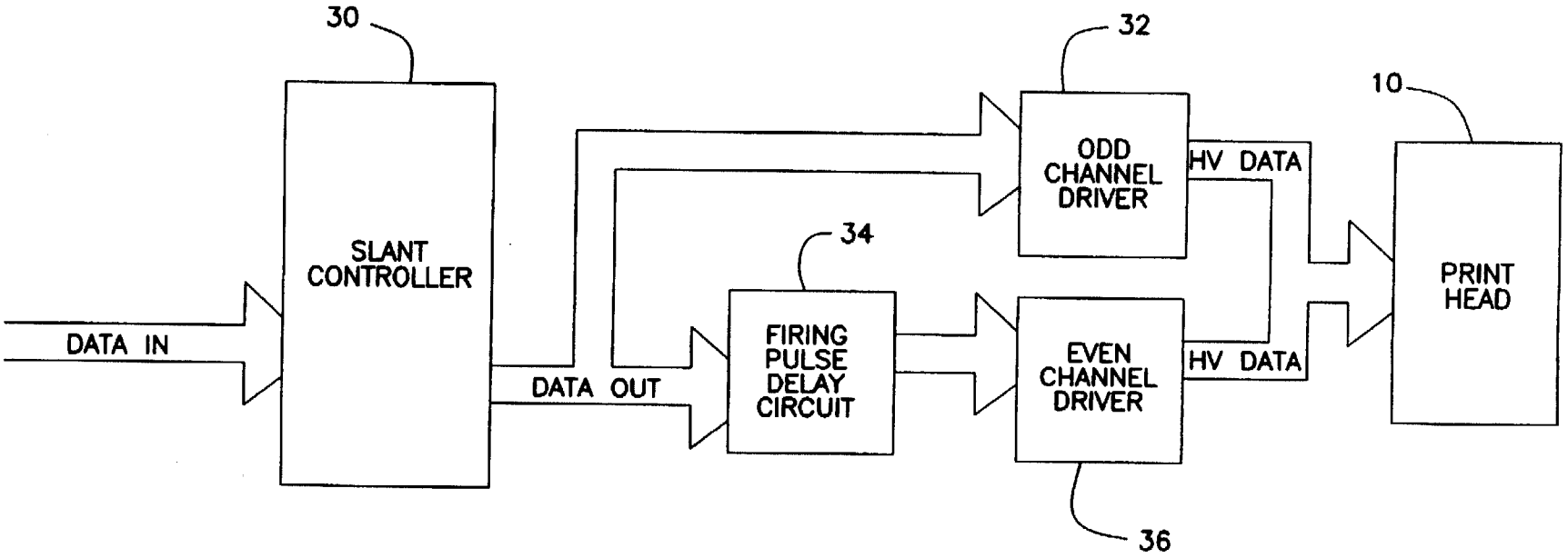
FIG. 14 is a block diagram of a pulse delay circuit in accordance with the present invention.

FIG. 14 is a block diagram of a pulse delay circuit in accordance with the present invention. This circuit includes a slant controller 30, an odd channel driver 32, a firing pulse delay circuit 34, and an even channel driver 36. The channel drivers 32 and 36 are coupled and provide firing pulses to a print head 10. The slant controller 30 is preferably an integrated circuit which performs the skewing shift register function for the angled chamber printhead of the presently preferred embodiment of the invention. The circuit performs the necessary control, addressing, and data manipulation to produce a "slanted" data format, which is then serially shifted into the channel driver integrated circuits. The channel drivers 32 and 36 are preferably low voltage serial to high voltage parallel converter integrated circuits with push-pull outputs. These components provide the high voltage needed to drive impulse ink jet products of the kind for which the present invention is especially suited. The delay circuit 34 is preferably composed of TTL integrated circuits for "delaying" the signal that enables the high voltage outputs of the channel driver integrated circuits.

Figure 15:
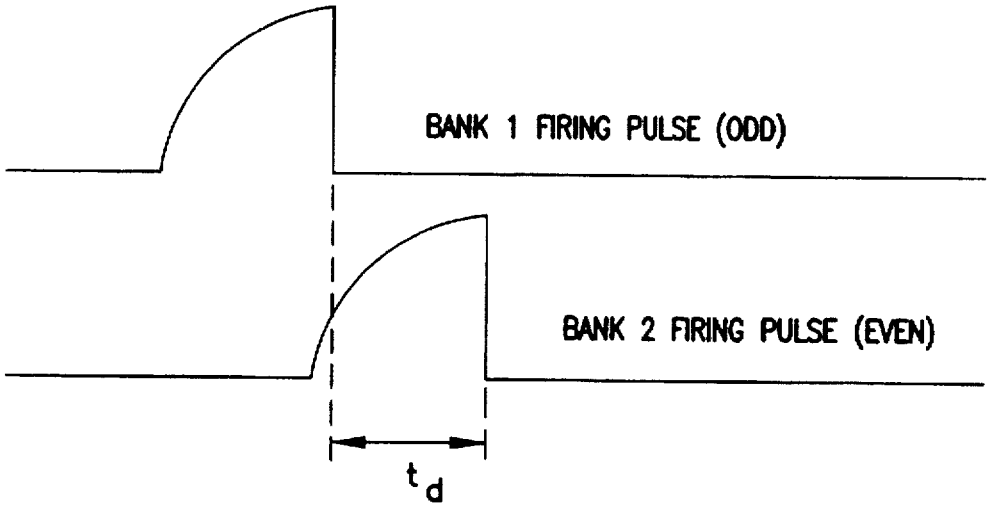
FIG. 15 is a timing diagram illustrating the delay of odd and even bank firing signals in accordance with the present invention.

FIG. 15 is a timing diagram illustrating the delay of odd and even bank firing signals in accordance with the present invention. In presently preferred embodiments of the invention, the time delay separating the firing of even channel jets from the firing of odd channel jets is less than approximately 25 microseconds and greater than approximately 12 microseconds. Preferably, the time delay is selected to ensure that adjacent ink droplets are offset by less than the diameter of the drops. The delay timing requirements are determined by the fill/fire times required for the printhead to achieve maximum jet velocity for a given voltage while also retaining jet chamber and meniscus stability.

Figure 16:
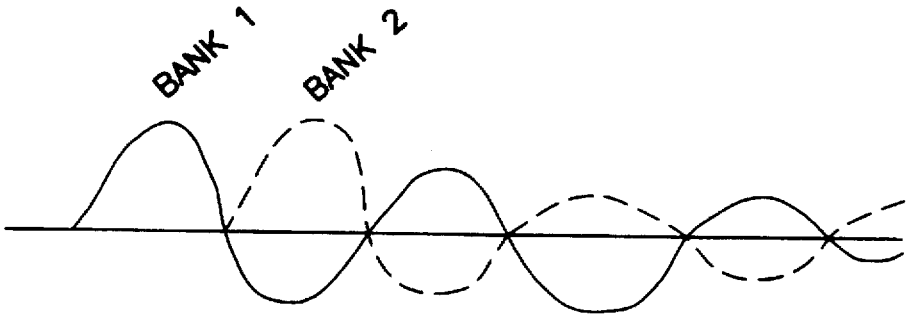
FIG. 16 depicts waveforms illustrating the natural ringing of piezo crystals.

FIG. 16 depicts waveforms illustrating the natural ringing of piezo crystals. The natural ringing has been found to be at a frequency of about 20 kHz (period=50 ms). Thus, a delay of about 25 ms (one-half the period) is employed so that the second bank of channels is not fired until after a half-cycle of ringing of the first bank occurs, which has been found to minimize cross-talk among adjacent channels.

Although preferred embodiments of the invention have been shown and described, it will be appreciated that various modifications may be made which will fall within the true spirit and scope of the invention as set forth in the appended claims.

I claim:

1. An ink jet apparatus comprising:

a linear array of impulse ink jets, each of said jets including a chamber having at least an orifice and a transducer coupled to said chamber;

signal generating means for applying firing signals to each said transducer for ejecting droplets of ink through said orifices; and control means for preventing simultaneous application of said firing signals to adjacent ink jets in said array, wherein said transducers are characterized by a natural ringing cycle and the firing signals applied to said adjacent jets are offset in time by a portion of said ringing cycle.

2. The ink jet apparatus of claim 1 wherein said adjacent ink jets produce ink droplets having a diameter and adjacent droplets are offset by less than the diameter.

3. The ink jet apparatus of claim 1 wherein the firing signals applied to said adjacent jets are offset in time by approximately one-half of said ringing cycle.

4. An ink jet apparatus comprising:

a linear array of impulse ink jets, each of said jets including a chamber having at least an orifice and a transducer coupled to said chamber;

signal generating means for applying firing signals to each said transducer for ejecting droplets of ink through said orifices; and control means for preventing simultaneous application of said firing signals to adjacent ink jets in said array, wherein said signal generating means comprises means for generating a plurality of firing signals of substantially a same phase; and said control means comprises means for delaying a phase of a first set of said firing signals relative to a phase of a second set of said firing signals.

5. The ink jet apparatus of claim 4 wherein said linear array of ink jets includes a first set of ink jets coupled to said first set of firing signals and a second set of ink jets coupled to said second set of firing signals, said first set of ink jets being interposed between said second set of ink jets.

6. An ink jet apparatus comprising:

a linear array of impulse ink jets including a first bank of ink jets and a second bank of ink jets, members of said first bank of ink jets being interposed and located between members of said second bank of ink jets, respectively;

means for generating firing signals to excite transducers of said ink jets; and means for controlling the phase of said firing signals so as to prevent the simultaneous application of firing signals to an ink jet in said first bank and an ink jet in said second bank, wherein said transducers are characterized by a natural ringing cycle and the firing signals applied to adjacent jets are offset in time by a portion of said ringing cycle.

7. The ink jet apparatus of claim 6 wherein the firing signals applied to said adjacent jets are offset in time by approximately one-half of said ringing cycle.

8. The ink jet apparatus of claim 6 wherein the space between adjacent ink jets in said first bank and said second bank is sufficiently close so as to result in cross-talk if the ink jets are fired substantially simultaneously.

9. The ink jet apparatus of claim 6 wherein the spacing between a transducer in said first bank and a transducer in said second bank is less than or equal to 0.250 inches.

10. A method of operating an ink jet apparatus comprising an array of impulse ink jets, comprising the steps of:

generating a plurality of firing signals;

applying said firing signals to transducers of said ink jets in said array such that a firing signal of adjacent ink jets in said linear array are displaced in phase, wherein said firing signals are generated with substantially a same phase; and delaying the phase of a first set of said firing signals relative to the phase of a second set of said firing signals.

11. A method of operating an ink jet apparatus comprising an array of impulse ink jets comprising the steps of:

generating a plurality of firing signals;

applying said firing signals to transducers of said ink jets in said array such that a firing signal of adjacent ink jets in said linear array are displaced in phase, wherein said transducers are characterized by a natural ringing cycle, and offsetting in time the firing signals applied to said adjacent jets by a portion of said ringing cycle.

12. The method of claim 11 wherein the firing signals applied to said adjacent jets are offset in time by approximately one-half of said ringing cycle.

13. The method of claim 11 wherein said adjacent ink jets produce ink droplets having a diameter and adjacent droplets are offset by less than the diameter.

* * * * *